US006982394B2

(12) United States Patent
Ide et al.

(10) Patent No.: US 6,982,394 B2
(45) Date of Patent: Jan. 3, 2006

(54) KEYSHEET MODULE

(75) Inventors: Hidehiko Ide, Yamanashi (JP); Isao Miyashita, Fujiyoshida (JP)

(73) Assignee: Citizen Electronics Co., Ltd., Yamanashi (JP)

( * ) Notice: Subject to any disclaimer, the term of this patent is extended or adjusted under 35 U.S.C. 154(b) by 0 days.

(21) Appl. No.: 11/001,033

(22) Filed: Dec. 2, 2004

(65) Prior Publication Data

US 2005/0121299 A1 Jun. 9, 2005

(30) Foreign Application Priority Data

Dec. 5, 2003 (JP) ..... 2003-407787

(51) Int. Cl.
*H01H 13/70* (2006.01)

(52) U.S. Cl. ..... 200/516; 200/515; 200/406

(58) Field of Classification Search ..... 200/5 A, 200/406, 515, 516; 341/22; 345/168; 400/490, 400/491, 491.2, 495, 495.1, 496
See application file for complete search history.

(56) References Cited

U.S. PATENT DOCUMENTS 5,924,555 A * 7/1999 Sadamori et al. ..... 200/512
6,259,046 B1 * 7/2001 Iwama et al. ..... 200/5 A
6,548,778 B2 * 4/2003 Takahashi ..... 200/516
6,593,537 B2 * 7/2003 Teruyama et al. ..... 200/515
6,604,278 B2 * 8/2003 Sera et al. ..... 29/622
6,730,869 B2 * 5/2004 Teruyama et al. ..... 200/516
6,768,074 B2 * 7/2004 Iwama ..... 200/515

FOREIGN PATENT DOCUMENTS

JP 2001-038305 2/2001
JP 2002-17457 6/2002

* cited by examiner

*Primary Examiner*—Michael A. Friedhofer
(74) *Attorney, Agent, or Firm*—Browdy and Neimark

(57) ABSTRACT

The keysheet module has a flexible printed circuit board formed with dome-shaped depression switches on the upper surface thereof. Each of the depression switches comprises a first fixed contact, a second fixed contact surrounding the first fixed contact, a movable contact arranged over these fixed contacts to electrically connect and disconnect the first fixed contact and the second fixed contact, and a switch holding sheet arranged on the flexible printed circuit board to cover and hold the movable contact. An insulating film of an insulating paste is formed on the flexible printed circuit board in such a way that it has air holes formed therein to release air trapped in the movable contact. The switch holding sheet is arranged over the insulating film.

4 Claims, 6 Drawing Sheets

KEYSHEET MODULE

CROSS REFERENCE TO RELATED APPLICATION

The application claims the priority benefit of Japanese Patent Application No. 2003-407787, filed on Dec. 5, 2003, the entire description of which are incorporated herein by reference.

BACKGROUND OF THE INVENTION

1. Field of the Invention

The present invention relates to a keysheet module used in small electronic devices such as mobile phones.

2. Description of Related Art

Small electronic devices such as mobile phones have conventionally built in a keysheet module having parts, such as dome-shaped contact switches and LEDs, mounted on a flexible printed circuit board (FPC board). The keysheet module is arranged on the underside of a keypad formed integral with a plurality of keytops (see Japanese Patent Disclosure Nos. 2002-170457 and 2001-35305).

FIG. 6 to FIG. 8 illustrate an example construction of a conventional keysheet module. In these figures, a keysheet module 1 comprises a flexible printed circuit board 2 formed by glass epoxy resin, a plurality of dome-shaped depression switches 3 provided on an upper surface of the flexible printed circuit board 2, fine wiring patterns 4 formed on the flexible printed circuit board 2, electronic parts arranged appropriately between the wiring patterns 4, such as light emitting diodes 5 as a backlight illuminating the keytops and resistors 6, and a sheet 80 fixedly bonded to the upper surface of the flexible printed circuit board 2. The sheet 80 has air holes 70 that are formed in the sheet and connect openings 71, formed at positions corresponding to movable contacts 13 of the depression switches 3, to allow air trapped in the movable contacts 13 to escape (see FIG. 7). This arrangement is made to provide the user with a good clicking feel as he or she depresses the depression switches 3. The sheet 80 also functions as a white reflection plate that reflects light emitted from the light emitting diodes 5.

Over the movable contacts 13, a switch holding sheet 90 is fixedly bonded to the upper surface of the sheet 80. The switch holding sheet 90 is a transparent sheet that covers the movable contacts 13 for appropriate positioning and holding. Further, the keysheet module 1 has a flexible connector 10 provided with power supply and signal wires for the supply of electricity to the keysheet module 1 and for the transfer of signals to and from the module.

The dome-shaped depression switches 3, as shown in FIG. 8, are each made up of a first fixed contact 11 formed on the flexible printed circuit board 2, a roughly ring-shaped second fixed contact 12 surrounding the first fixed contact 11, and the dome-shaped movable contact 13 connected to the second fixed contact 12. The first fixed contact 11 is connected to a wiring pattern not shown and the second fixed contact 12 is connected to a wiring pattern 4*a*. The movable contact 13 is formed by an elastic thin metal such as stainless steel. In FIG. 8, reference number 14 represents a solder resist layer printed over the flexible printed circuit board 2 to protect the wiring pattern 4*a*.

Next, an operation of each of the depression switches 3 with the above construction will be explained. The movable contact 13 of the depression switch 3 has its lower peripheral portion in contact with the second fixed contact 12 and out of contact with the first fixed contact 11 at all times. In other words, the depression switch 3 is open or off. In this state, when the movable contact 13 is pressed down from above the switch holding sheet 90, it is elastically depressed and comes into contact with the first fixed contact 11, turning on the depression switch 3. At this time, air trapped in the movable contact 13 is pushed out of the air holes 70 in the sheet 80, giving the depression switch 3 a good clicking feel. Then, when the depressing force is released from the movable contact 13, the movable contact 13 returns to its original state by its own elastic force, turning off the depression switch 3.

This conventional keysheet module 1, however, has a problem that since the air trapped in the movable contact 13 is released through the air holes 70 in the sheet 80, the keysheet module requires the sheet 80, increasing the number of parts and therefore the number of assembly steps of the keysheet module 1.

Japanese Patent Disclosure No. 2001-35305 discloses a construction in which an adhesive layer is provided instead of the sheet 80, with air holes formed in the adhesive layer. However, this construction has a drawback that the air holes are easily deformed, making the amount of air discharged unstable, which may in turn degrade the clicking feel when the dome-shaped depression switch is pressed.

SUMMARY OF THE INVENTION

An object of this invention is to provide a keysheet module which has a smaller number of parts to reduce the number of keysheet module assembly steps and which can offer a good clicking feel when a depression switch is pressed.

To realize the above objective, this invention provides a keysheet module having a flexible printed circuit board formed with a plurality of depression switches on an upper surface thereof, each of the depression switches comprising: a first fixed contact; a second fixed contact surrounding the first fixed contact; a movable contact arranged over these fixed contacts to electrically connect and disconnect the first fixed contact and the second fixed contact; and a switch holding sheet arranged on the flexible printed circuit board to cover and hold the movable contact; wherein an insulating film of an insulating paste is formed on the flexible printed circuit board in such a way that it has air holes formed therein to release air trapped in the movable contact; wherein the switch holding sheet is arranged over the insulating film.

In this invention, at least one of the insulating film and the switch holding sheet is white in color and has a reflection plate function of reflecting light emitted from light emitting diodes.

Further, in this invention, a protruding deformation prevention wall is formed in the air holes provided in the insulating film to prevent the switch holding sheet from being deflected into the air holes.

With this invention, since the insulating film formed by an insulating paste and formed on the flexible printed circuit board has air holes formed therein to release air which is trapped in the movable contact, the conventional sheet can be eliminated. This in turn reduces the number of parts and therefore the number of keysheet module assembly steps. Further, since the air holes are provided in the insulating film, the deformation of the air holes can be prevented effectively, giving a stable clicking feel when the depression switch is pressed.

Further, since the protruding deformation prevention wall is formed in the air holes to prevent the switch holding sheet from being deflected into the air holes, the air holes can be kept from being closed by the switch holding sheet. This ensures that the space in the air holes can be kept constant, allowing a predetermined volume of air to escape through the air holes whenever the depression switch is pressed. Thus a stable clicking feel can be obtained when the switch is depressed.

Further, the combined use of the flexible printed circuit board and the insulating film using the insulating paste can produce an effect of making the keysheet module elastic and decreasing in thickness.

DETAILED DESCRIPTION OF THE PREFERRED EMBODIMENTS

An example keysheet module of this invention in a preferred configuration will be described by referring to the accompanying drawings.

Figure 1:
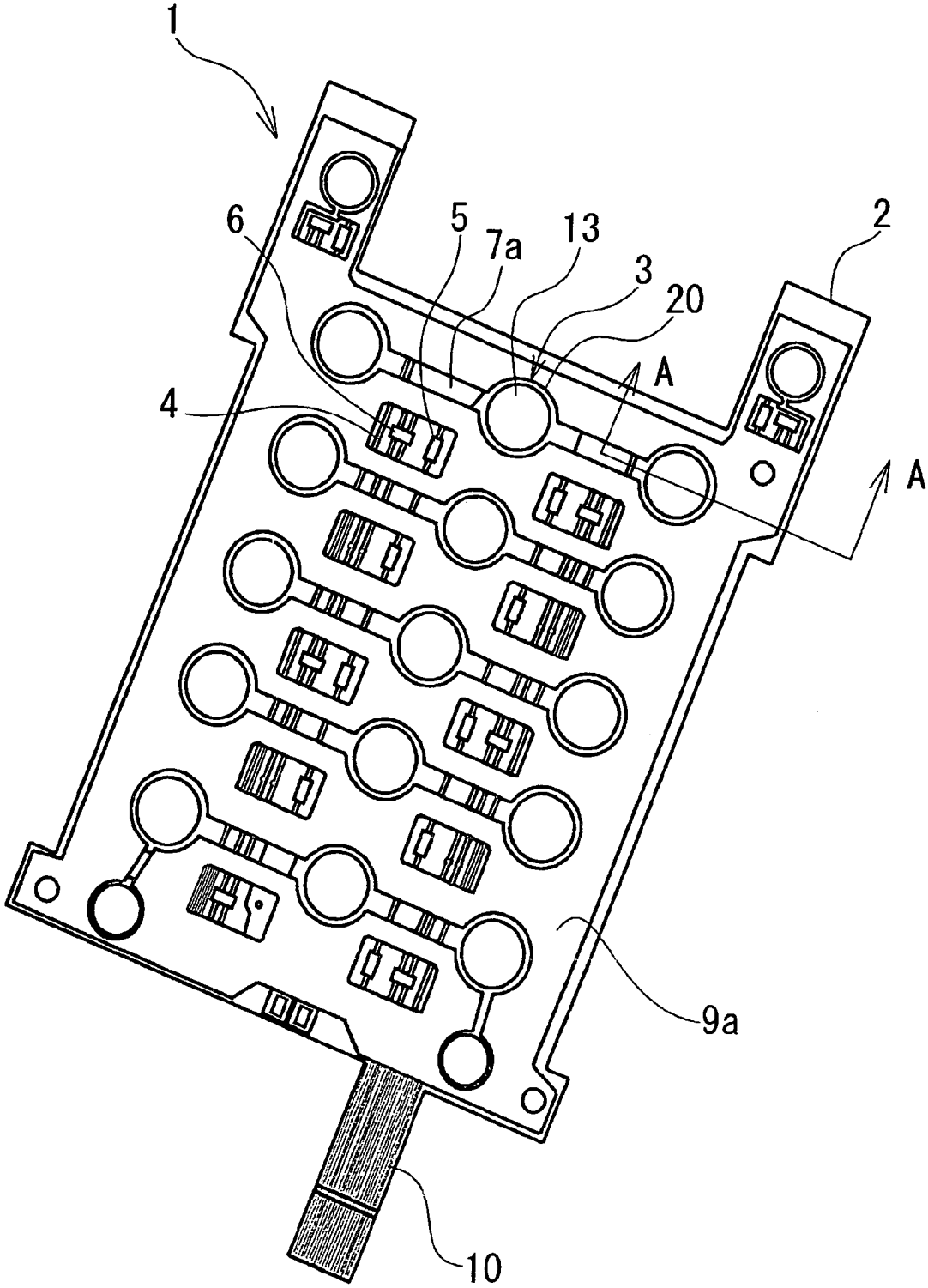
FIG. 1 is a plan view of a keysheet module as a first embodiment of this invention.
Figure 2:
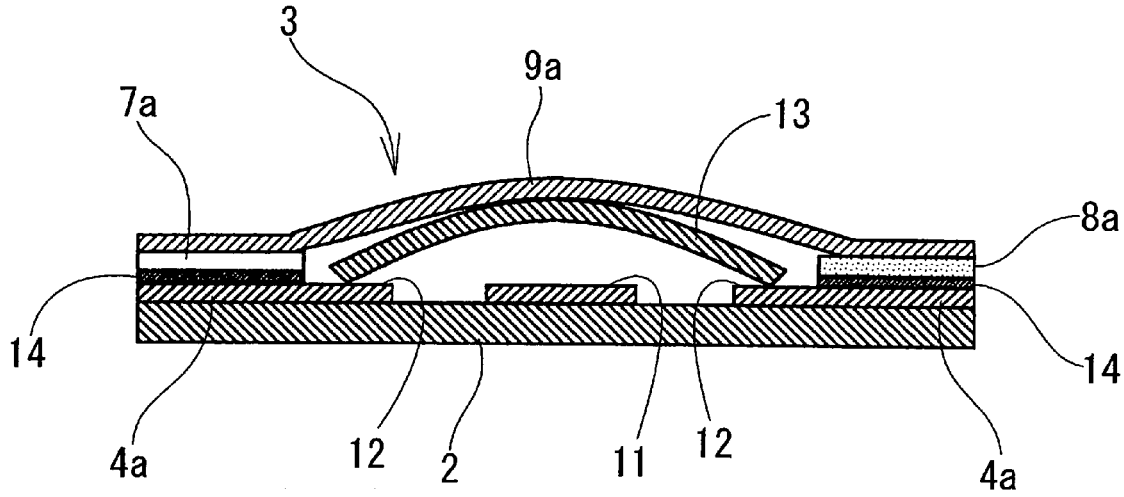
FIG. 2 is an enlarged cross-sectional view taken along the line A—A of FIG. 1.

As shown in FIG. 1 and FIG. 2, the keysheet module 1 of this invention is almost similar in basic construction to conventional keysheet modules and has a flexible printed circuit board 2 formed of glass epoxy resin, a plurality of dome-shaped depression switches 3 provided on an upper surface of the flexible printed circuit board 2, fine wiring patterns 4 formed over the flexible printed circuit board 2, and electronic parts, such as light emitting diodes 5 functioning as a backlight for keytops and resistors 6, arranged between the wiring patterns 4.

The upper surface of the flexible printed circuit board 2 is printed with a white insulating paste to form an insulating film 8*a* that will take the place of the conventional sheet 80. The insulating film 8*a* works as a reflection plate to reflect light emitted from the light emitting diodes 5 upward and has a plurality of openings 20 formed therein at positions corresponding to the movable contacts 13 and also air holes 7*a* to allow air trapped in each movable contact 13 to escape. Arranged over the insulating film 8*a* is a transparent switch holding sheet 9*a* that covers and is held appressed to the movable contacts 13. The switch holding sheet 9*a* is securely bonded to the upper surface of the insulating film 8*a* to position and hold the movable contacts 13. Further, the keysheet module 1 has a flexible connector 10 provided with power supply and signal wires for supplying electricity to the keysheet module 1 and for transferring signals to and from the module.

The dome-shaped depression switches 3 have a similar construction to that of conventional keysheet modules described earlier and comprise a first fixed contact 11 formed on the flexible printed circuit board 2, a roughly ring-shaped second fixed contact 12 surrounding the first fixed contact 11, and the dome-shaped movable contact 13 disposed over these fixed contacts 11, 12. The first fixed contact 11 is connected to a wiring pattern not shown and the second fixed contact 12 is connected to a wiring pattern 4*a*. The movable contact 13 is formed by an elastic thin metal such as stainless steel. Reference numeral 14 represents a solder resist layer printed over the flexible printed circuit board 2 to protect the wiring pattern 4*a*.

The dome-shaped depression switch 3 of the above construction operates as follows. Normally, the movable contact 13 of the depression switch 3 is in contact with the second fixed contact 12 but out of contact with the first fixed contact 11 and therefore the depression switch 3 is open or off. In this state, when the movable contact 13 is pressed down from above the switch holding sheet 9*a*, it is elastically depressed and comes into contact with the first fixed contact 11, connecting the first fixed contact 11 and the second fixed contact 12 to turn on the depression switch 3. When the top of the movable contact 13 is depressed, air trapped in the movable contact 13 is pushed out through the air holes 7*a* formed in the insulating film 8*a*, giving the depression switch 3 a good clicking feel. Then, when the depressing force is released from the movable contact 13, the movable contact 13 returns to its original state by its own elastic force, turning off the depression switch 3.

As described above, in a keysheet module 1 of this invention the insulating film 8*a* formed by an insulating paste is used to replace the conventional sheet 80 and the insulating film 8*a* has air holes 7*a* to release air from within the movable contacts 13. Since the insulating film 8*a* is formed by printing a white insulating paste, the light emitted from the underside of the light emitting diodes 5, that passes through the transparent switch holding sheet 9*a*, is reflected by the insulating film 8*a*. The insulating film 8*a* has as good a reflection efficiency as the conventional sheet 80.

For the insulating paste forming the insulating film 8*a*, a white pigment, such as titanium white (titanium dioxide), may be used. An overcoat clear, when used in combination with the titanium white, has an effect of retaining a gloss. By printing such an insulating paste, the light emitted from the light emitting diodes 5 can be reflected efficiently. In this invention since the insulating film 8*a* is formed by printing the insulating paste, it is possible not only to eliminate the conventional sheet 80 but also to make the keysheet module elastic by the use of the flexible printed circuit board 2, which in turn contributes to a reduction in the overall thickness of the device.

Further, the air holes 7*a* in the insulating film 8*a* can be formed at the same time that the insulating paste is printed. If the air holes 7*a* fail to be formed to have a sufficient depth in one printing process, the printing process may be repeated two or more times. Providing the air holes 7*a* in the insulating film 8*a* as described above makes the air holes 7*a* not easily deformable, keeping the predetermined groove shape intact. This ensures that the depression switch 3 offers a good clicking feel when depressed.

Further, since the insulating paste printing can be performed by leaving an electronic part mounting space unprinted, electronic parts such as light emitting diodes, resistors and capacitors can be mounted even after the insulating paste is printed.

Figure 3:
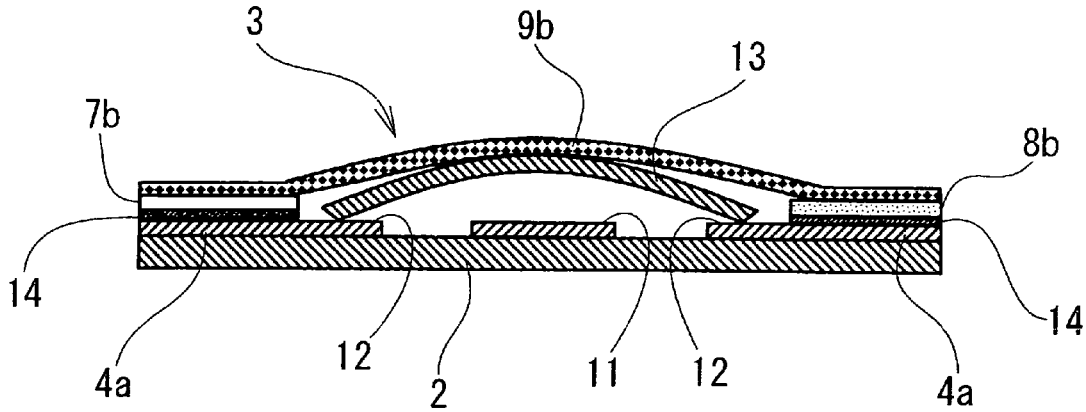
FIG. 3 is a cross-sectional view, similar to FIG. 2, showing a second embodiment of this invention.

FIG. 3 shows a second embodiment of the keysheet module according to this invention. In the keysheet module of this embodiment, as with the preceding embodiment, an insulating paste to form an insulating film 8*b* is printed on an upper surface of the flexible printed circuit board 2 and the insulating film 8*b* has air holes 7*b* formed therein to release air trapped in the movable contacts 13. The movable contacts 13 of the depression switches 3 are securely held by a switch holding sheet 9*b* covering them from above. What differs from the previous embodiment is that the insulating film 8*b* is not given a function of the reflection plate but that the white switch holding sheet 9*b* is given the reflection plate function to reflect light emitted from the underside of the light emitting diodes 5. In other respects, the construction of this embodiment is similar to that of the first embodiment, so their detailed description is omitted.

Since the insulating film 8*b* does not have the reflection plate function, the insulating plate need not be white in color. For example, it may be formed by one or more of desired insulating materials (epoxy resin, UV), pigments, fluorescent materials and light accumulation materials. As in the first embodiment, a material with excellent bending and appressed-contact characteristics is preferably used.

Figure 4:
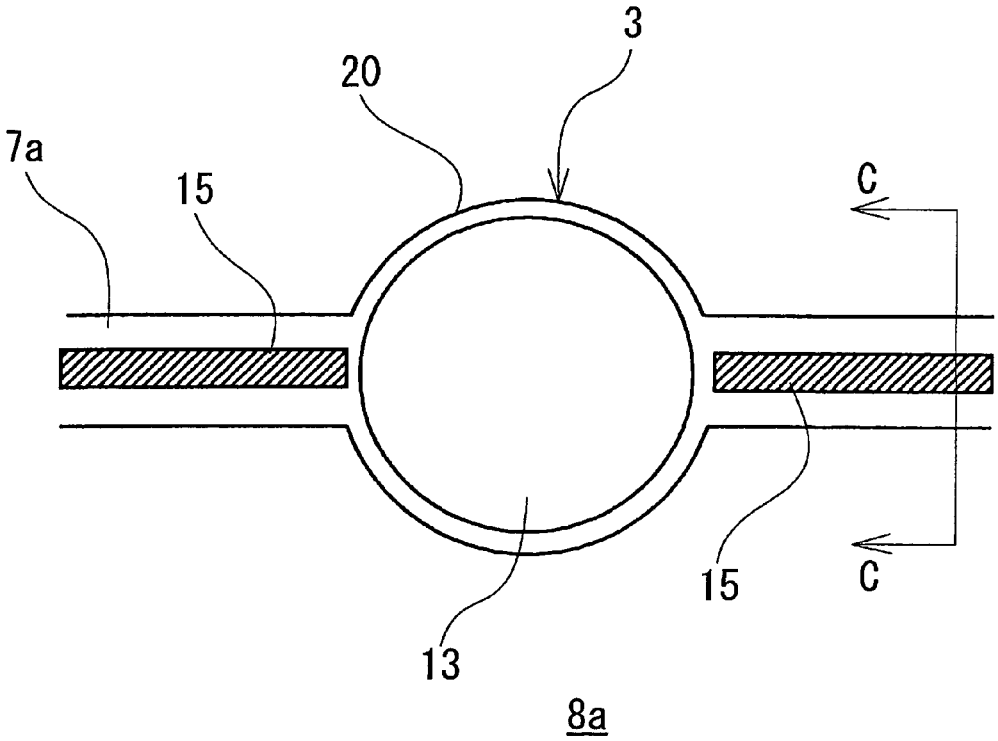
FIG. 4 is an enlarged plan view showing air holes in an insulating film in a third embodiment of this invention.
Figure 5:
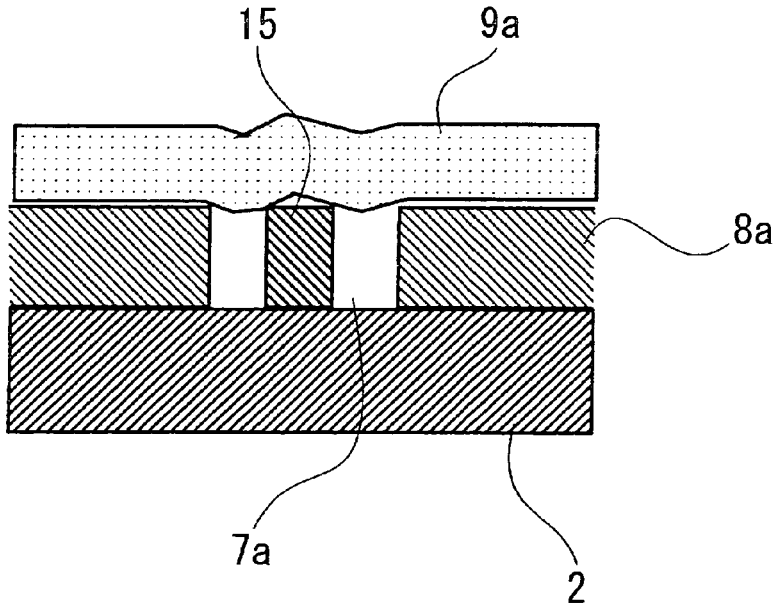
FIG. 5 is a cross-sectional view taken along the line C—C of FIG. 4.
Figure 6:
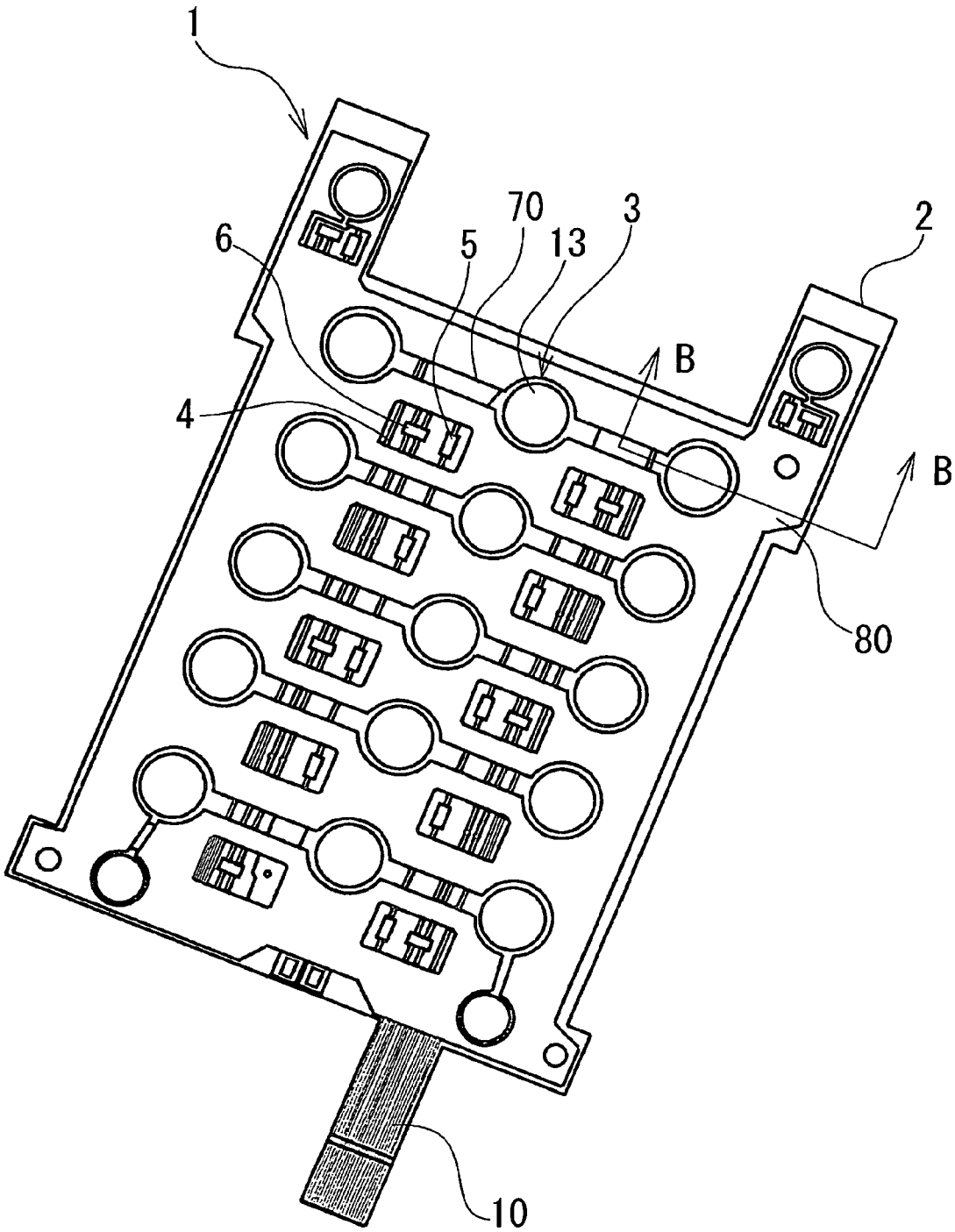
Fig. 6 (Prior Art)
FIG. 6 is a plan view showing an example of a conventional keysheet module.
Figure 7:
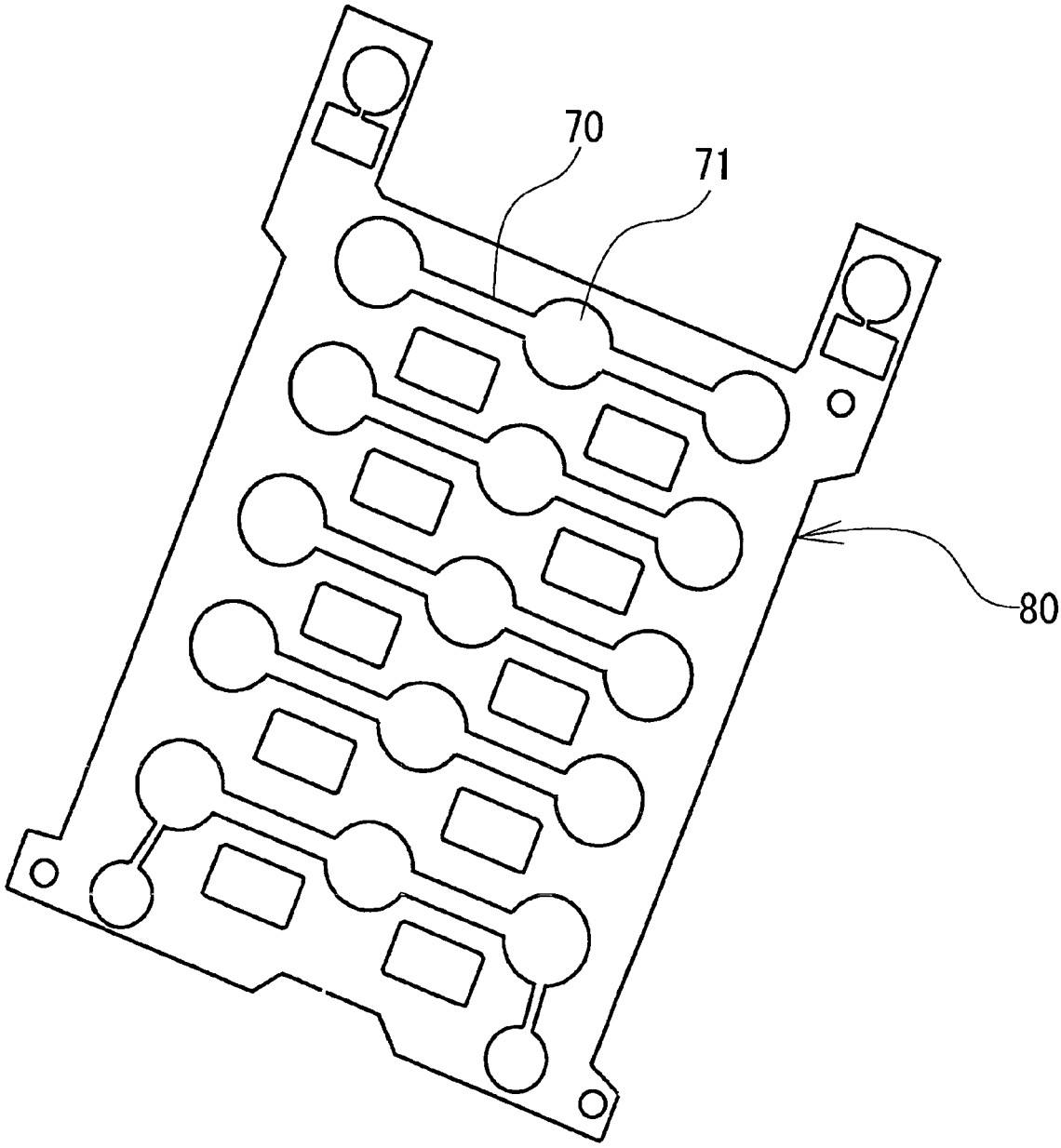
Fig. 7 (Prior Art)
FIG. 7 is a plan view showing a sheet used in the conventional keysheet module.
Figure 8:
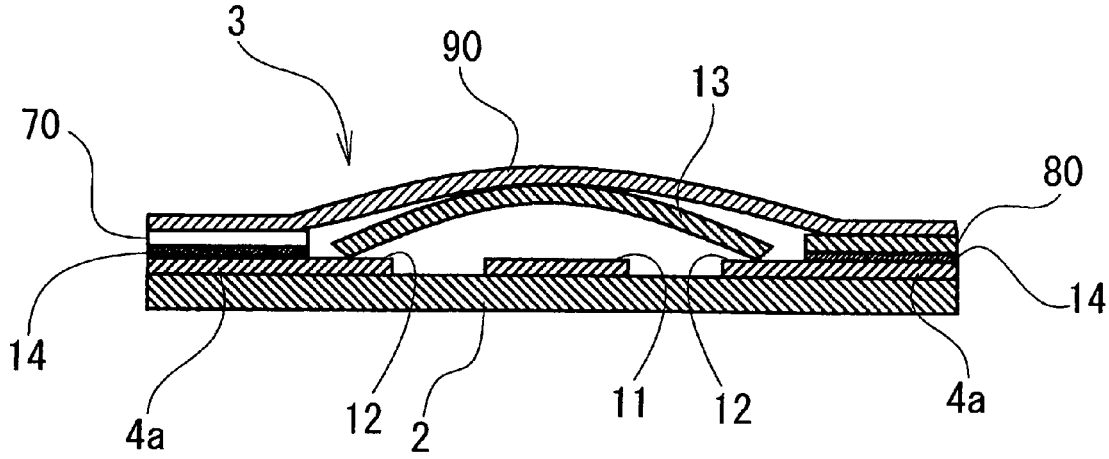
Fig. 8 (Prior Art)
FIG. 8 is an enlarged cross-sectional view taken along the line B—B of FIG. 7.

FIG. 4 and FIG. 5 represent a third embodiment of the keysheet module according to this invention, FIG. 4 being an enlarged plan view showing air holes 7*a* formed in the insulating film 8*a*, FIG. 5 being a cross-sectional view taken along the line C—C of FIG. 4.

In this embodiment, a strip of deformation prevention wall 15 is printed along the center of each air hole 7*a* formed in the insulating film 8*a* of the first embodiment to effectively prevent the air holes 7*a* from being closed when the switch holding sheet 9*a* is deflected.

The provision of the deformation prevention wall 15 along the center of the air holes 7*a* prevents the switch holding sheet 9*a* over the air holes 7*a* from being deformed. Thus, the air holes 7*a* can be protected against being closed by the switch holding sheet 9*a*, maintaining a constant space therein, so that the depression switch 3 offers a stable clicking feel at all times when depressed. It is of course possible to apply this construction also to the second embodiment.

Preferred embodiments of this invention have been described. It is noted, however, that this invention is not limited to these examples.

It is also noted that the keysheet module for electronic devices of this invention is not limited to the cell phone applications but can be applied to a wide range of electronic devices including DVD and audio equipment and digital cameras.

What is claimed is:

1. A keysheet module having a flexible printed circuit board formed with a plurality of depression switches on an upper surface thereof, each of the depression switches comprising:

a first fixed contact;

a second fixed contact surrounding the first fixed contact;

a movable contact arranged over the fixed contacts to electrically connect and disconnect the first fixed contact and the second fixed contact; and a switch holding sheet arranged on the flexible printed circuit board to cover and hold the movable contact;

wherein an insulating film formed by an insulating paste is formed on the flexible printed circuit board and the insulating film includes air holes formed to release air trapped in the movable contact; and wherein a protruding deformation prevention wall is formed in each of the air holes provided in the insulating film to prevent the switch holding sheet from being deflected into the air holes.

2. A keysheet module according to claim 1, wherein at least one of the insulating film and the switch holding sheet is white in color and has a reflection plate function of reflecting light emitted from light emitting diodes.

3. A keysheet module according to claim 1, wherein the depression switch is dome-shaped and turned on by depressing the top portion thereof.

4. A keysheet module according to claim 1, wherein a strip-shaped deformation prevention wall is formed at a central portion of the air hole.

* * * * *